US009966203B2

(12) United States Patent
Bieringer et al.

(10) Patent No.: US 9,966,203 B2
(45) Date of Patent: May 8, 2018

(54) METHOD OF DETERMINING AN OPERATIONAL SETTING OF AN ON-LOAD TAP CHANGER

(71) Applicants: Alfred Bieringer, Geiselhoering (DE); Dominik Plitzko, Regensburg (DE); Sebastian Schmid, Regensburg (DE)

(72) Inventors: Alfred Bieringer, Geiselhoering (DE); Dominik Plitzko, Regensburg (DE); Sebastian Schmid, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 129 days.

(21) Appl. No.: 14/377,733

(22) PCT Filed: Mar. 25, 2013

(86) PCT No.: PCT/EP2013/056245
§ 371 (c)(1),
(2) Date: Aug. 8, 2014

(87) PCT Pub. No.: WO2013/160044
PCT Pub. Date: Oct. 31, 2013

(65) Prior Publication Data

US 2016/0035506 A1 Feb. 4, 2016

(30) Foreign Application Priority Data

Apr. 27, 2012 (DE) ..... 10 2012 103 742
May 10, 2012 (DE) ..... 10 2012 104 089

(51) Int. Cl.
*H01H 9/00* (2006.01)

(52) U.S. Cl.
CPC ..... *H01H 9/0027* (2013.01); *H01H 9/0033* (2013.01); *H01H 9/0038* (2013.01); *H01H 2009/0061* (2013.01)

(58) Field of Classification Search
CPC ..... H01H 9/0027; H01H 2009/0061; H01H 9/0033
See application file for complete search history.

(56) References Cited

U.S. PATENT DOCUMENTS 5,619,121 A * 4/1997 Trainor ..... G05F 1/147 323/256
5,760,492 A * 6/1998 Kanoi ..... H02J 3/06 307/18

(Continued)

FOREIGN PATENT DOCUMENTS

DE 9216746 U 5/1994

*Primary Examiner* — Shawki S Ismail
*Assistant Examiner* — Muhammad S Islam
(74) *Attorney, Agent, or Firm* — Andrew Wilford

(57) ABSTRACT

An operational setting of an on-load tap changer used to switch between various winding taps of a tapped transformer is determined by first placing the on-load tap changer in operation with the tapped transformer and then moving the changer in a first rotational direction through a regulating range of its stationary operational settings on different winding taps of the tapped transformer toward an end abutment of the tapped transformer. The position is registered on reaching the end abutment of the regulating range of the on-load tap changer, and then the movement is reversed to return to the first stationary operational setting that is then configured as a predefined operational setting with the help of the parameterization that is stored in a nonvolatile memory of the control device.

4 Claims, 1 Drawing Sheet

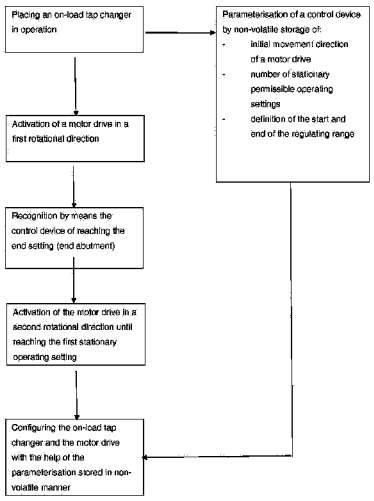

(56) References Cited

U.S. PATENT DOCUMENTS

| | | | | |
|---|---|---|---|---|
| 6,087,607 | A * | 7/2000 | Dohnal | H01H 9/0033 200/11 TC |
| 6,100,674 | A * | 8/2000 | Dohnal | H01H 9/0005 323/256 |
| 7,463,010 | B2 * | 12/2008 | Dohnal | H01H 9/0027 318/563 |
| 2008/0074073 | A1 * | 3/2008 | Genkawa | H02P 13/06 318/779 |
| 2009/0063063 | A1 * | 3/2009 | Hernandez | H01F 29/04 702/58 |
| 2011/0297517 | A1 * | 12/2011 | Armstrong | H01H 9/0038 200/50.37 |
| 2012/0139510 | A1 | 6/2012 | Wrede | |

* cited by examiner

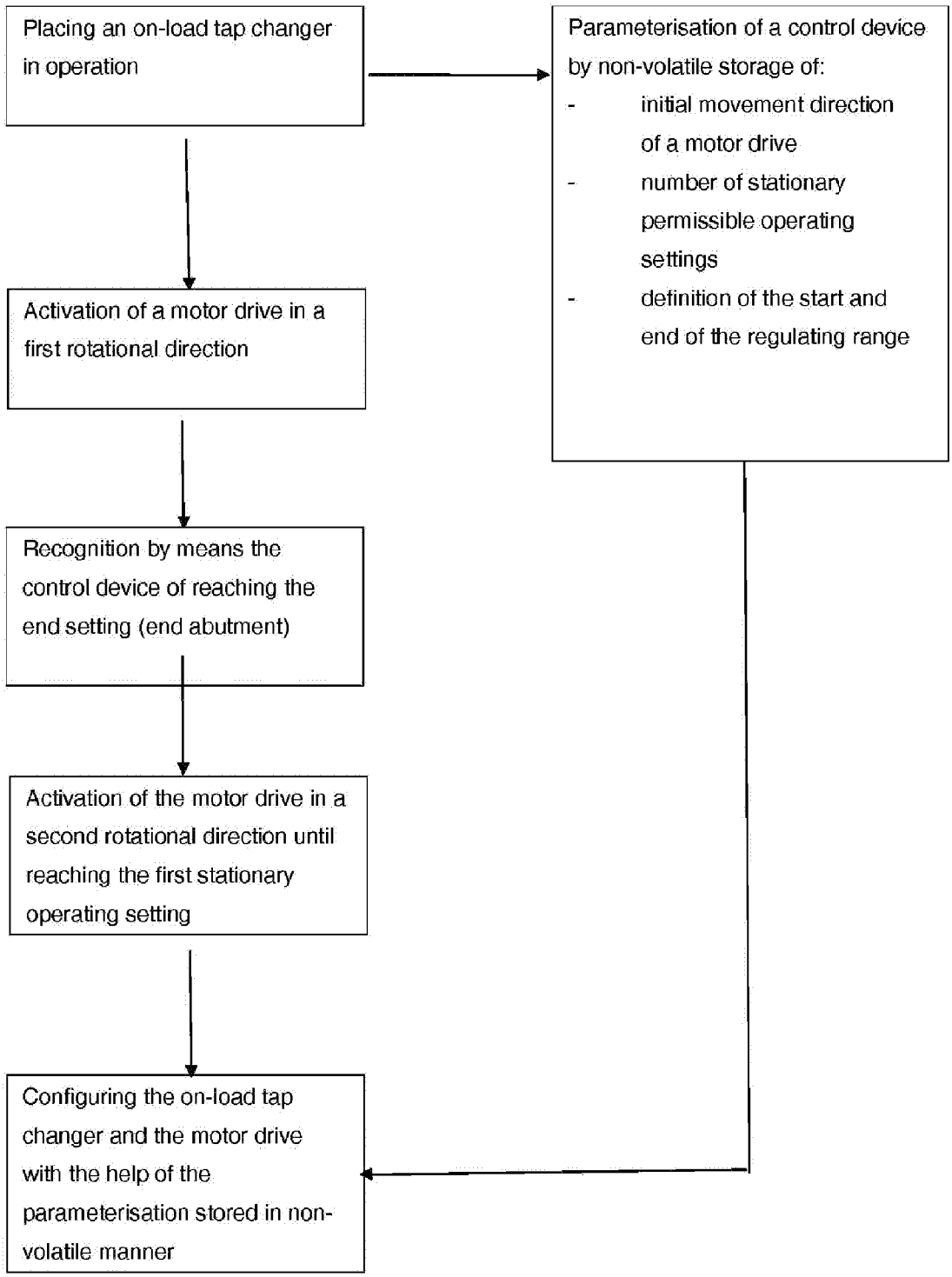
Placing an on-load tap changer in operation
Parameterisation of a control device by non-volatile storage of:
- initial movement direction of a motor drive
- number of stationary permissible operating settings
- definition of the start and end of the regulating range
Activation of a motor drive in a first rotational direction
Recognition by means the control device of reaching the end setting (end abutment)
Activation of the motor drive in a second rotational direction until reaching the first stationary operating setting
Configuring the on-load tap changer and the motor drive with the help of the parameterisation stored in non-volatile manner

METHOD OF DETERMINING AN OPERATIONAL SETTING OF AN ON-LOAD TAP CHANGER

CROSS REFERENCE TO RELATED APPLICATIONS

This application is the US-national stage of PCT application PCT/EP2013/056245 filed 25 Mar. 2013 and claiming the priority of German patent application 102012103742.6 itself filed 27 Apr. 2012 and German patent application 102012104089.3 itself filed 10 May 2012.

FIELD OF THE INVENTION

The present invention relates to a method for determining a defined operational setting of an on-load tap changer for switching between different winding taps of a tapped transformer.

On-load tap changers have been in use in large numbers on a worldwide basis for many years for uninterrupted changeover between different winding taps of tapped transformers. So-called reactor switches that are widespread particularly in North America, have a switching reactance enabling a slow, continuous switching. On-load tap changer according to the resistance fast switching principle usually consist of a selector for power-free selection of the respecting winding tap of the tapped transformer that is to be switched to and a load changeover switch for the actual switching from the previous to the new, preselected winding tap. The load changeover switch for that purpose usually comprises switch contacts and resistance contacts. In that case the switching contacts serve for direct connection of the respective winding tap with the load diverter and the resistance contacts for temporary connection, i.e. bridging by one or more switch-over resistances. However, developments in recent years have led away from load changeover switches with mechanical switch contacts in insulating oil. Instead, use is increasingly made of vacuum interrupters as switching elements.

An on-load tap changer of that kind with vacuum interrupters is disclosed in, for example, DE 10 2009 043 171 A1. Here, an on-load changer carries a drive shaft that is drivable by a force accumulator, with at least one cam disc. The cam disk has a plurality of control cams, wherein two control cams arranged at the end of the cam disk have a profile that departs from a circular shape, in the form of cam lobes, at which a respective roller that is connected by way of a tip lever with a vacuum interrupter and that scans the profiled contour of the respective control cam, is guided with maintained contact.

On-load tap changers known from the prior art are usually supplied to customers as fully assembled products and are installed by these on site in an existing tapped transformer. For this purpose, an operating instruction that quite comprehensively documents and describes the installation of the tap regulating equipment is enclosed by the manufacturer. Placing in operation, i.e. coupling, of the tap regulating equipment inclusive of motor drive with the tapped transformer and the electronic control system thereof requires, in individual assembly steps, manually controlled connection of different tap positions of the regulating winding of the tapped transformer, in that the tap regulating equipment is switched between adjacent fixed contacts electrically connected with the regulating winding. According to the prior art this procedure is time-consuming and on occasion liable to error.

A setting reporting arrangement for an on-load tap changer has become known from DE 197 05 576 A1. Setting reporting arrangements as a component of the motor drive of tap changers or the like serve the purpose of detecting and communicating the respective setting of the tap changer or the like; this in turn is on the one hand the starting point for the actual setting indication and on the other hand, as actual value, the basis for subsequent controlling or regulating functions.

Known setting and reporting arrangements for tap changers consist of a circular arrangement of a plurality of reporting contacts, wherein an operational setting of a tap changer or the like is associated with at least one respective reporting contact. In that case the reporting contacts are connected by a rotatable central reporting contact lever that is connected with the tap changer, more precisely with the motor drive of the tap changer. The reporting contact lever is then, on each change of the operational setting of the tap changer, i.e. on each changeover from one winding tap to another, moved merely through a switching angle corresponding with the spacing of two adjacent reporting contacts. As a consequence of the continuous movement of the reporting contact lever, however, there is very slow contact separation that depending on the respective switching process can extend over several seconds. Such a setting reporting arrangement is thus not suitable if circuits operated by direct current are conducted via the reporting contacts or if in general there is to be switching of higher levels of current.

In the case of the setting reporting arrangements known from the prior art a fixed operational setting of the tap changer, i.e. winding tap of the regulating winding of the tapped transformer, is thus associated with each reporting contact. Here, too, the mechanical coupling or the adjustment of the tap changer with the setting reporting indication has to take place in accordance with a fixedly defined switching plan, since otherwise false operational settings of the setting reporting arrangement are indicated.

OBJECT OF THE INVENTION

Starting from that point it is the object of the present invention to indicate a method of determining a defined operational setting of an on-load tap changer for switching between different winding taps of a tapped transformer that, without manually controlled connection of different tap positions of the regulating winding, enables setting of a predefined operational setting of the on-load tap changer.

SUMMARY OF THE INVENTION

This object is fulfilled by a method of switching an on-load tap changer between different winding taps of a tapped transformer by determining a defined operational position on the regulating winding of an on-load tap changer. By determining a defined operational position is to be understood in the context of the present invention as the attainment of a predefined operational setting of the on-load tap changer.

The general inventive idea consists of reaching a predefined operational setting of the on-load tap changer in that after the on-load tap changer is placed in operation a motor drive is activated in a first rotational direction by a parameterized control device, so that the on-load tap changer begins to run through its stationary operational settings, thus the different winding taps of the tapped transformer, in the direction of the first winding tap. Reaching of the end abutment of the on-load tap changer is recognized by the control device, wherein subsequently the mode of drive is activated in a second rotational direction so that the load changeover switch subsequently runs through the regulating range in the opposite switching direction until reaching the first stationary operational setting and wherein subsequently a configuration of the first stationary operational setting as predefined operational setting is carried out with the help of the parameterization that is subject to the nonvolatile storage, of the control device. The method according to the invention thus independently defines, after the on-load tap changer has been placed in operation, a first stationary operational setting as reference variable for all subsequent switching actions. Since this defined operational setting is subject to software-assisted nonvolatile storage it is thus understandable at any later point in time how many changeovers in which changeover direction of the on-load tap changer have been executed and ultimately in which stationary operational setting the on-load tap changer is instantaneously disposed. In other words, according to the essence of the invention the mechanical abutment of the regulating range of the on-load tap changer is used in order to subsequently undertake normalization to a defined stationary operational setting of the on-load tap changer.

According to a particular development of the invention the control device recognizes the mechanical end abutment of the regulating range of the on-load tap changer in that the amperage of the motor drive after activation thereof in a first rotational direction is subject to nonvolatile storage and is compared at defined intervals in time with a maximum value parameterized in the control device as current limit value. If in that case the instantaneously detected current value exceeds the defined target value then an electrical signal is generated that indicates the mechanical end abutment of the on-load tap changer to the control device.

According to a further form of embodiment of the invention the mechanical end abutment of the regulating range of the on-load tap changer is detected by way of the control device in that the rotational speed of the drive shaft of the motor drive is detected at regular intervals in time by a sensor. If the ascertained value of the rotational speed is equal to 0, then an electrical signal is generated that indicates the mechanical end abutment of the on-load tap changer to the control device.

According to yet a further form of embodiment of the invention during transit of the regulating range of the on-load tap changer in a first rotational direction a reporting contact is connected on each occasion a next stationary operational setting is reached, wherein the trigger instant, i.e. the connection of the reporting contact, is subject to nonvolatile storage by the control device, wherein the time between two trigger instants is compared with a maximum permissible limit value, wherein in the case of exceeding the maximum permissible limit value an electrical signal is generated that indicates to the control device the mechanical end abutment of the on-load tap changer. This can take place, for example, in that at least one cam disk is brought into rotational engagement with the drive shaft of the motor drive, which cam disk in turn actuates at least one microswitch per revolution of the cam disk. Depending on the respective translation ratio the revolution of the cam disk can be synchronous with switching the load changeover switch from a first to an adjacent, second stationary operational setting. The microswitch is thus triggered once per revolution of the cam disk and accordingly per switching process, thus permissible stationary operational setting of the on-load tap changer, and thereby reports a successfully concluded switching process.

BRIEF DESCRIPTION OF THE DRAWING

A method according to the invention shall be explained in more detail in the following by way of example on the basis of a single FIGURE that is a schematic flow chart of the method according to the invention.

SPECIFIC DESCRIPTION OF THE INVENTION

Placing an on-load tap changer together with a tapped transformer into operation forms the starting point of the method according to the invention. When placed in operation, the on-load tap changer is connected by its connecting contacts with the regulating winding of the tapped transformer, the motor drive is mounted and the on-load tap changer and the motor drive are connected with a software-supported electronic parameterized control device that for its part can in turn be connected with an output device. The parameterized control device is to be parameterized when placing in operation takes place, in particular in that case an initial direction of movement of the drive shaft of the motor drive is to be defined, in addition a number of permissible stationary operational settings of the on-load tap changer is to be indicated, and finally it is to be defined where the start of the regulating range, i.e. the first permissible stationary operational setting, and the end of the regulating range, thus the last permissible operational setting, of the on-load tap changer lie. These parameters are to be stored in nonvolatile form in the parameterized control device. As already explained, on-load tap changers usually have a selector for power-free selection of the respective winding tap of the tapped transformer that is to be switched to and a load changeover switch for the actual changeover from the previous to the new, preselected winding tap. Depending on the switch type on which the on-load tap changer is based, in the case of a regulating winding with, for example, five winding taps five stationary operational settings are permissible in accordance with the resistance fast switching principle and nine stationary operational settings in accordance with the reactor switching principle, since here middle settings are acceptable as stationary operational settings.

Subsequently, a motor drive is activated by the then parameterized parameterized control device in a first rotational direction, so that the on-load tap changer begins to run through its stationary operational settings, thus the different winding taps of the tapped transformer, in the direction of the first winding tap. By first winding tap there is meant here the main winding of the tapped transformer at the next positioned winding tap of the regulating winding, thus the start of the regulating range of a tapped transformer. The motor drive is, for example, a step motor known from the prior art.

In a next following method step reaching of the end setting is recognized by the parameterized control device. By end setting there is to be understood in the context of the present invention the mechanical end abutment of the on-load tap changer against which the moved part of the on-load tap changer travels when it has reached the start or the end of its regulating range. This can take place, for example, through the parameterized control device recognizing the mechanical end abutment of the regulating range of the on-load tap changer in that the current intensity of the motor drive after activation thereof in a first rotational direction is subject to nonvolatile storage and is compared at defined intervals in time with a maximum value parameterized in the parameterized control device as current limit value. If in that case the instantaneously determined current value exceeds the defined target value then an electrical signal is generated that indicates to the parameterized control device the mechanical end abutment of the on-load tap changer. Alternatively, it is also possible for the mechanical end abutment of the regulating range of the on-load tap changer to be detected by way of the parameterized control device in that the rotational speed of the drive shaft of the motor drive is detected by a sensor at regular intervals in time. If the ascertained value of the rotational speed is equal to 0, then an electrical signal is generated that indicates the mechanical end abutment of the on-load tap changer to the parameterized control device. According to yet a further form of embodiment of the invention in the case of transiting of the regulating range of the on-load tap changer in a first rotational direction a reporting contact is connected on each attainment of the next stationary operational setting, wherein the trigger instant, i.e. the connection of the reporting contact, is subject to nonvolatile storage by the parameterized control device, wherein the time between two trigger instants is compared with a maximum permissible limit value, wherein in the case of exceeding the maximum permissible limit value an electrical signal is generated that indicates the mechanical end abutment of the on-load tap changer to the parameterized control device. This can be carried out, for example, in that at least one cam disk is brought into rotational engagement with the drive shaft of the motor drive, which cam disk for its part actuates at least one microswitch per revolution of the cam disk. Depending on the respective translation ratio the revolution of the cam disk can take place synchronously with switching of the load changeover switch from a first to an adjacent, second stationary operational setting. The microswitch is thus triggered once per revolution of the cam disk and accordingly per switching, thus permissible stationary operational setting of the on-load tap changer, and thereby reports a successfully concluded changeover process.

In a following method step the motor drive is activated by the parameterized control device in a second rotational direction so that the selector of the on-load tap changer subsequently runs through the regulating range in the opposite switching direction until reaching the first or predefined stationary operational setting. The motor drive stops on reaching the first stationary operational setting.

Finally, configuration of the first stationary operational setting as predefined operational setting is carried out with the help of the parameterization that is stored in nonvolatile manner, of the parameterized control device. The method according to the invention thus independently defines, after the on-load changer has been placed in operation, a first or predefined stationary operational setting as a reference variable for all subsequent switching processes. Since this defined operational setting is subject to software-assisted nonvolatile storage it is thus clear at any later point in time how many switchings in which switching direction of the on-load tap changer have been executed and ultimately in which stationary operational setting the on-load tap changer is instantaneously disposed. In other words, according to the essence of the invention the mechanical abutment of the regulating range of the on-load tap changer is thus used in order to subsequently undertake normalization to a defined stationary operational setting of the on-load tap changer.

The invention claimed is:

1. A method of determining a predefined operational setting of an on-load tap changer actuatable by a motor drive for switching between different winding taps of a tapped transformer, the method comprising the steps of:

placing the on-load tap changer in operation with the tapped transformer;

thereafter activating the motor drive by a parameterized control device in a first rotational direction so that the on-load tap changer begins to run through its stationary operational settings on different winding taps of the tapped transformer toward a first winding tap of the tapped transformer;

detecting reaching of an end abutment of the regulating range of the on-load tap changer by the parameterized control device;

activating the motor drive by the parameterized control device in a second opposite rotational direction so that the on load tap changer subsequently runs through the regulating range until reaching the first stationary operational setting; and subsequently configuring the first stationary operating setting as a predefined operational setting with the help of the parameterization that is stored in a nonvolatile memory of the control device.

2. The method defined in claim 1, further comprising the steps of:

detecting reaching of the end abutment of the on-load tap changer by the control device by the substeps of:

monitoring a current intensity of the motor drive after activation thereof in a first rotational direction subject to nonvolatile storage, comparing this current intensity subject to nonvolatile storage at defined intervals in time with a maximum value parameterized as current limit value in the control device, and if a previously defined target value is exceeded by the instantaneously determined current intensity, generating an electrical signal by the control device so that the control device indicates the mechanical end abutment of the on-load tap changer.

3. The method defined in claim 1, wherein reaching of the end abutment of the on-load tap changer is detected by the control device by the substeps of:

detecting the rotational speed of the drive shaft of the motor drive by a sensor at regular intervals in time and, on reaching the determined value of 0 of the rotational speed, generating an electrical signal by the control device so that the control device indicates the mechanical end abutment of the on-load tap changer.

4. The method defined in claim 1, further comprising the steps of:

detecting reaching of the end abutment of the on-load tap changer by the control device in that during transit of the regulating range of the on-load tap changer in a first rotational direction a reporting contact is connected on each attainment of a next stationary operational setting, storing the trigger instant in a nonvolatile memory of the control device, comparing the time between two trigger instants with a maximum permissible limit value, and if the maximum permissible limit value is exceeded, generating an electrical signal so that the control device indicates the mechanical end abutment of the on-load tap changer.

* * * * *